US008869518B2

(12) United States Patent
Yetkin et al.

(10) Patent No.: US 8,869,518 B2
(45) Date of Patent: Oct. 28, 2014

(54) BURNER FOR A DIESEL AFTERTREATMENT SYSTEM

(75) Inventors: Dervis Argun Yetkin, Ann Arbor, MI (US); Ginette Alyce Anderson, Mason, MI (US)

(73) Assignee: Tenneco Automotive Operating Company Inc., Lake Forest, IL (US)

( * ) Notice: Subject to any disclaimer, the term of this patent is extended or adjusted under 35 U.S.C. 154(b) by 1005 days.

(21) Appl. No.: 12/881,858

(22) Filed: Sep. 14, 2010

(65) Prior Publication Data

US 2011/0061369 A1 Mar. 17, 2011

Related U.S. Application Data

(60) Provisional application No. 61/276,645, filed on Sep. 15, 2009.

(51) Int. Cl.
*F01N 3/025* (2006.01)

(52) U.S. Cl.
CPC ..... *F01N 3/025* (2013.01); *F01N 2240/14* (2013.01)
USPC ..... 60/303

(58) Field of Classification Search
CPC ... F01N 3/025; F01N 3/2033; F01N 2240/14; F01N 2240/20; F01N 2470/08; B01F 5/061; B01F 5/0616; B01F 5/0618; B01F 2005/0634
USPC ..... 60/295, 303, 311; 366/336, 337
See application file for complete search history.

(56) References Cited

U.S. PATENT DOCUMENTS

2007/0245718 A1 10/2007 Cheng et al.
2008/0307780 A1 12/2008 Iverson et al.
2009/0255242 A1 10/2009 Paterson et al.
2010/0107617 A1 5/2010 Kaiser et al.

OTHER PUBLICATIONS

International Search Report and Written Opinion dated Oct. 25, 2010.

*Primary Examiner* — Kenneth Bomberg
*Assistant Examiner* — Jonathan Matthias
(74) *Attorney, Agent, or Firm* — Wood, Phillips, Katz, Clark & Mortimer

(57) ABSTRACT

A burner (18) is provided for use in a diesel exhaust gas treatment system (10) to treat an exhaust flow (12) from a diesel combustion process (14). The burner (18) includes an inner housing (34) defining a combustion flow path (40) to direct a first portion of the exhaust flow (12) through an ignition zone (42) wherein fuel is ignited, an outer housing (32) surrounding the inner housing (34) to define an annular bypass flow path (44) between the inner and outer housings (34, 32) to bypass a second portion of the exhaust flow (12) around the ignition zone (42), and a mixer (48) including a plurality of flow restrictor fingers (50) that extend across the bypass flow path (44) to restrict an available flow area of the bypass flow path (44), and a plurality of mixer fingers (52) having portions that extend inwardly from a location downstream from the inner housing (34).

20 Claims, 4 Drawing Sheets

BURNER FOR A DIESEL AFTERTREATMENT SYSTEM

CROSS-REFERENCE TO RELATED APPLICATIONS

This application claims the benefit of the filing date of U.S. Provisional Application No. 61/276,645, filed Sep. 15, 2009, which is hereby incorporated by reference in its entirety.

FEDERALLY SPONSORED RESEARCH OR DEVELOPMENT

Not Applicable.

MICROFICHE/COPYRIGHT REFERENCE

Not Applicable.

FIELD OF THE INVENTION

This invention relates to systems and methods for treating exhaust gases from a diesel combustion process, such as a diesel compression engine, and more particularly to systems for reducing oxides of nitrogen ($NO_x$) and particulate matter (PM) emissions from diesel compression engines.

BACKGROUND OF THE INVENTION

Environmental regulations have called for increasing emission limits that require reduction in the $NO_x$ and PM from diesel combustion processes, and in particular from diesel compression engines. While diesel particulate filters (DPF) are capable of achieving the required reductions in PM, which is typically carbonaceous particulates in the form of soot, there is a continuing need for improved systems that can provide the required reductions in $NO_x$, often in connection with the particulate matter reduction provided by a DPF.

In this regard, systems have been proposed to provide a diesel oxidation catalyst (DOC) upstream from a DPF in order to provide an increased level of $NO_2$ in the exhaust which reacts with the soot gathered in the DPF to produce a desired regeneration of the DPF (often referred to as a passive regeneration). However, such systems become limited at temperatures below 300° C. and typically produce a pressure drop across the oxidation catalyst that must be accounted for in the design of the rest of the system. Additionally fuel, such as hydrogen or hydrocarbon fuel, can be delivered upstream of the DOC to generate temperatures greater than 600° F. in the DPF (often referred to as active regeneration).

It has also been proposed to include a burner within such systems to ignite and combust fuel in the exhaust downstream from the diesel combustion process to selectively increase the temperature for exhaust treatment processes downstream from the burner. Examples of such proposals are shown in commonly assigned and co-pending U.S. patent application Ser. No. 12/430,194, filed Apr. 27, 2009, entitled "Diesel Aftertreatment System" by Adam J. Kotrba et al, the entire disclosure of which is incorporated herein by reference.

While current burners for such systems may be suitable for their intended purpose, there is always room for improvement. For example, the pressure drop and/or back pressure associated with such burners is always important when other exhaust treatment devices are included in the system, as is thermal mixing of the exhaust exiting such a burner so that potentially damaging hot spots can be removed from within the exhaust flow exiting the burner and a reasonably uniform exhaust temperature profile can be provided to the downstream portion of the system.

SUMMARY OF THE INVENTION

In accordance with one form of the invention, a burner is provided for use in a diesel exhaust gas treatment system to treat an exhaust flow from a diesel combustion process. The burner includes a housing defining a combustion flow path to direct a first portion of the exhaust flow through an ignition zone wherein fuel is ignited, a bypass flow path to bypass a second portion of the exhaust flow around the ignition zone, and a mixing zone downstream of the combustion flow path and the bypass flow path to receive the first and second portions of the exhaust flow therefrom. The burner also includes a mixer located downstream of the ignition zone, with the mixer including a plurality of flow restrictor fingers that extend across the bypass flow path to restrict an available flow area of the bypass flow path and a plurality of mixer fingers that extend into the mixing zone to be impinged against by both the first and second portions of the exhaust flow exiting the bypass flow path and the combustion flow path.

As one feature, the housing includes an inner housing surrounded by an outer housing, with the combustion flow path defined within the inner housing and the bypass flow path defined between the inner housing and the outer housing.

As a further feature, the inner housing and outer housing have cylindrical shapes and the bypass flow path has an annular cross-section defined between the inner and outer housings. In yet a further feature, the mixer further includes an annular flange mounted to an interior surface of the outer housing, with the flow restrictor fingers and the mixer fingers extending in a downstream direction from one side of the flange.

In a further feature, each of the flow restrictor fingers extends inward from the outer housing to a terminal end that is spaced a selected distance from the inner housing to define a restricted flow gap between the terminal end and the inner housing.

According to a further feature, each of the mixer fingers extend along the outer housing to a location downstream from the inner housing and extend inwardly from the location to a location in the mixing zone.

In one feature, the mixer is a made from a single, stamped piece of sheet metal.

According to one feature, the flow restrictor fingers and the mixer fingers alternate along a length of the mixer. As a further feature, the length is a circumferential length extending transverse to a flow direction defined by the bypass flow path.

As one feature, the inner housing, outer housing, and mixer are fabricated components that are bonded together during assembly of the burner.

In accordance with one feature of the invention, a burner is provided for use in a diesel exhaust gas treatment system to treat an exhaust flow from a diesel combustion process. The burner includes an inner housing defining a combustion flow path to direct a first portion of the exhaust flow through an ignition zone wherein fuel is ignited, an outer housing surrounding the inner housing to define a bypass flow path between the inner and outer housings to bypass a second portion of the exhaust flow around the ignition zone, a mixing zone downstream of the combustion flow path and the bypass flow path to receive the first and second portions of the exhaust flow therefrom, and a mixer including a plurality of flow restrictor fingers that extend across the bypass flow path to restrict an available flow area of the bypass flow path and a plurality of mixer fingers that extend into the mixing zone to be impinged against by both the first and second portions of the exhaust flow exiting the bypass flow path and the combustion flow path.

As one feature, the inner housing and outer housing have cylindrical shapes and the bypass flow path has an annular cross-section defined between the inner and outer housings. As a further feature, the mixer further includes an annular flange mounted to an interior surface of the outer housing, with the flow restrictor fingers and the mixer fingers extending in a downstream direction from one side of the flange.

In one feature, each of the flow restrictor fingers extends inward from the outer housing to a terminal end that is spaced a selected distance from the inner housing to define a restricted flow gap between the terminal end and the inner housing.

According to one feature, each of the mixer fingers extend along the outer housing to a location downstream from the inner housing and extend inwardly from the location to a location in the mixing zone.

In accordance with one feature of the invention, a burner is provided for use in a diesel exhaust gas treatment system to treat an exhaust flow from a diesel combustion process. The burner includes a cylindrical shaped inner housing defining a combustion flow path to direct a first portion of the exhaust flow through an ignition zone wherein fuel is ignited, a cylindrical shaped outer housing surrounding the inner housing to define an annular bypass flow path between the inner and outer housings to bypass a second portion of the exhaust flow around the ignition zone, and a mixer including a flange fixed to an inner surface of the outer housing, a plurality of flow restrictor fingers that extend from the flange across the bypass flow path to restrict an available flow area of the bypass flow path, and a plurality of mixer fingers having portions that extend inwardly from a location downstream from the inner housing.

As one feature, each of the flow restrictor fingers extends inward from the flange to a terminal end that is spaced a selected distance from the inner housing to define a restricted flow gap between the terminal end and the inner housing, and each of the mixer fingers extend inwardly to a location that is radially inward of the inner housing.

In accordance with one feature of the invention, a method is shown for providing burners for use in at least two diesel exhaust gas treatment systems having different operating conditions, each of the burners operating to ignite fuel for selectively raising the temperature of an exhaust flow from a diesel combustion process. The method includes the steps of:

providing at least two burners, each of the burners being made from components that are common to all of the burners, the components includes an inner housing to defining a combustion flow path, an outer housing surrounding the inner housing to define an bypass flow path, and a mixer having a plurality of flow restrictor fingers extending into the bypass flow path;

adjusting a position of a plurality of the flow restrictor fingers relative to an inner housing in a first one of the burners to create a first desired restricted flow area across the bypass flow path to achieve a first desired ratio of bypass flow to combustion flow for one of the at least two diesel exhaust gas treatment systems having different operating conditions; and adjusting a position of a plurality of the flow restrictor fingers relative to an inner housing in a second one of the burners to create a second desired restricted flow area across the bypass flow path to achieve a second desired ratio of bypass flow to combustion flow for another of the at least two diesel exhaust gas treatment systems having different operating conditions.

Other objects, features, and advantages of the invention will become apparent from a review of the entire specification, including the appended claims and drawings.

DETAILED DESCRIPTION OF THE PREFERRED EMBODIMENT

Figure 1:
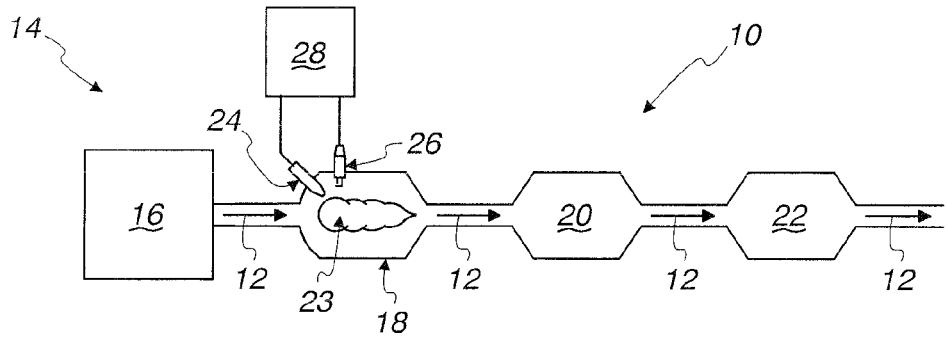
FIG. 1 is a diagrammatic representation of a diesel exhaust gas treatment system employing a burner embodying the invention for use in connection with a diesel combustion process.

FIG. 1 shows a diesel exhaust gas aftertreatment system 10 for treating the exhaust 12 from a diesel combustion process 14, such as a diesel compression engine 16. The exhaust 12 will typically contain oxides of nitrogen ($NO_x$) such as nitric oxide (NO) and nitrogen dioxide ($NO_2$) among others, particular matter (PM), hydrocarbons, carbon monoxide (CO), and other combustion byproducts.

The system 10 includes a burner 18 that selectively supplies the exhaust 12 at an elevated temperature to the rest of the system 10 by selectively igniting and combusting fuel in the exhaust 12, wherein the fuel is introduced into the exhaust 12, and/or carried in the exhaust 12 as unburned fuel from the combustion products. The ability to provide the exhaust 12 at an elevated temperature to the rest of the system 10 provides a number of advantages, some of which will be discussed in more detail below.

The system 10 also preferably includes one or more other exhaust treatment devices, such as a diesel particulate filter (DPF) 20 connected downstream from the burner 18 to receive the exhaust 12 therefrom, and a $NO_x$ reducing device 22, such as a selective catalytic reduction catalyst (SCR) or a lean $NO_x$ trap 26 connected downstream from the DPF 20 to receive the exhaust 12 therefrom. One advantage of the burner 18 is its ability to overcome the lower operating temperatures in the exhaust 12 of lean-burn engines, such as the diesel compression engine 16, by employing an active regeneration process for the DPF 20 wherein fuel is ignited in the burner 18 to create a flame 23 that heats the exhaust 12 to an elevated temperature that will allow for oxidation of the PM in the DPF 20. Additionally, in connection with such active regeneration, or independent thereof, the burner 18 can be used in a similar manner to heat the exhaust 12 to an elevated temperature that will enhance the conversion efficiency of the $NO_x$ reducing device 22, particularly an SCR. Advantageously, the burner 18 can provide such elevated temperatures, either selectively or continuously, independent of any particular engine operating condition, including operating conditions that produce temperatures less than 300° C. in the exhaust 12 as it exits the engine 16, and including operating conditions that produce temperatures greater than 300° C. Thus, the system 10 can be operated without requiring adjustments to the engine controls.

Figure 2:
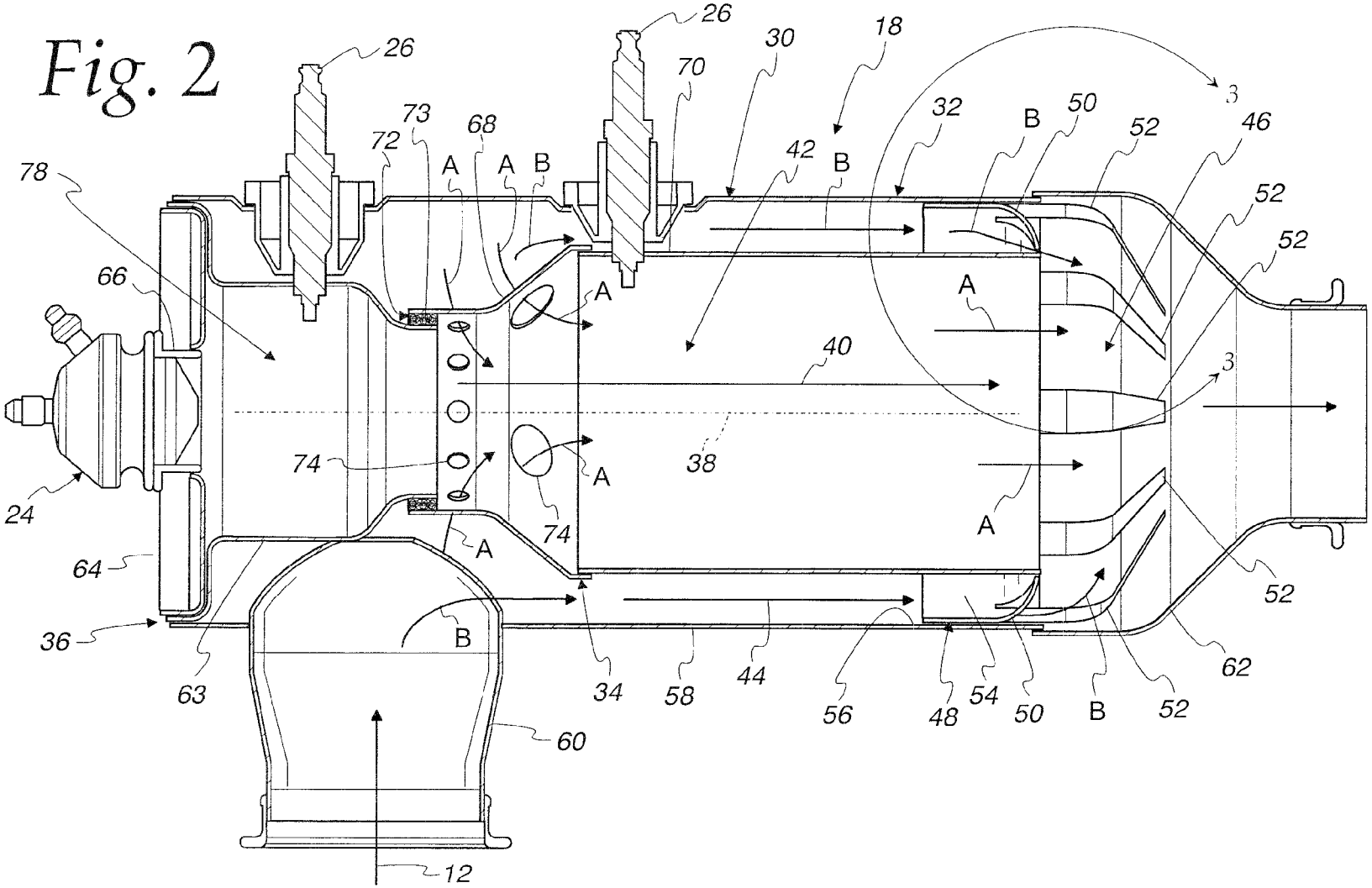
FIG. 2 is an enlarged transverse cross-sectional view of a burner for use in the system of FIG. 1 and embodying the present invention, with the relative sizes of the components being somewhat diagrammatic for purposes of illustration.

The burner 18 preferably will include one or more injectors 24 for injecting suitable fuel, a couple examples of which are hydrogen and hydrocarbons, and an oxygenator, such as air, to be ignited together with unburned fuel already carried in the exhaust by one or more igniters, such as spark plugs 26. In this regard, each injector 24 can either be a combined injector that injects both the fuel and oxygenator, as shown in FIG. 2, or a specific injector for one of the fuel or the oxygenator. Preferably, a control system, shown schematically at 28 in FIG. 1, is provided to monitor and control the flows through the injector(s) 24 and the ignition by the igniters 26 using any suitable processor(s), sensors, flow control valves, electric coils, etc.

As best seen in FIG. 2, the burner 18 includes a housing 30 that in the illustrated embodiment is provided in the form of a multi-piece assembly of fabricated sheet metal components. In this regard, the housing 30 includes a cylindrical-shaped outer housing 32, a cylindrical-shaped inner housing 34, and a cylindrical-shaped end cap/injector housing 36, all centered on a central axis 38. The inner housing 34 defines a combustion flow path 40 to direct a first portion of the exhaust 12 (shown by arrows A and hereinafter the "combustion flow") through an ignition zone 42 wherein unburned fuel carried in the exhaust 12 is ignited. An annular bypass flow path 44 is defined in an annulus between the outer and inner housings 32 and 34 to bypass a second portion of the exhaust 12 (shown by arrows B and hereinafter the "bypass flow") around the ignition zone 42 to be remixed in a mixing zone 46 with combustion flow exiting the combustion flow path 40.

Figure 4:
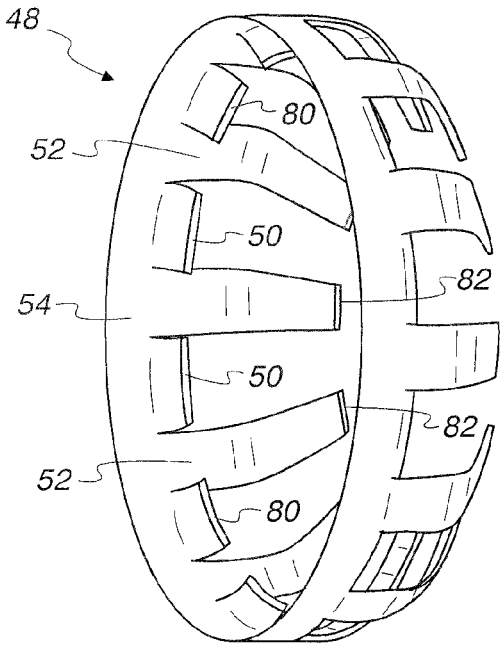
FIG. 4 is an enlarged perspective view from an upstream side of a mixer component used in the burner.

With reference to FIGS. 2 and 4, the burner 18 also includes a mixer 48 having a plurality (eight in the embodiment of FIG. 2 and twelve in the embodiment of FIG. 4) of flow restrictor fingers 50 that extend across the bypass flow path 44 to restrict an available flow area of the bypass flow path 44, and a plurality (eight in the embodiment of FIG. 2 and twelve in the embodiment of FIG. 4) of mixer fingers 52 that extend into the mixing zone 46 to be impinged against by both the bypass flow and the combustion flow exiting the bypass flow path 44 and the combustion flow path 40, and to guide the bypass flow exiting the bypass flow path 44 into the mixing zone 46. The mixer 48 includes an annular mount flange 54 from which the fingers 50 and 52 extend in the downstream direction. The flange 54 is fixed to an interior surface 56 of the outer housing 32 so as to secure the mixer 48 within the housing 10. The mixer 48 is made from a single, stamped piece of sheet metal.

In the illustrated embodiment, the outer housing 32 is a multi-piece, sheet metal fabrication and includes a cylindrical primary housing 58, an inlet duct 60 for receiving the exhaust 12, and an outlet duct 62 for directing the exhaust 12 to the remainder of the system 10. In the illustrated embodiment, the outlet duct 62 also defines the mixing zone 46. While particular forms of the inlet and outlet ducts 60 and 62 are shown, it should be appreciated that any suitable form of inlet and outlet ducts 60 and 62 can be utilized for the burner 18, as required by the particular system in which it is incorporated. For example, while the outlet duct 62 is shown as tapering from a larger diameter to a smaller diameter, the outlet duct 62 could maintain a constant diameter and include an integrated exhaust treatment device, such as an integrated DPF 20. By way of further example, the outlet duct 62 could also be constructed so as to direct the exhaust 12 out radially to a remainder of the system 10, rather than axially. The end cap/injector housing 36 is also a multi-piece, sheet metal fabrication and includes an injection plenum/nozzle 63, an end cap 64, and an injector mount flange 66. The inner housing 34 in the illustrated embodiment is also a multi-piece, sheet metal fabrication that includes a diffuser/exhaust inlet plenum 68 and a cylindrical combustion sleeve 70. The diffuser/exhaust inlet plenum 68 surrounds an end of the injection plenum/nozzle 63 to define an annular area 72 that preferably is filled with a suitable gasket, such as a wire mesh gasket 73, that can allow for differential thermal expansion of the components. The diffuser/exhaust inlet plenum 68 further includes a plurality of circular openings or windows 74 that allow combustion flow to be drawn into the combustion flow path 40 by the flow of air and fuel (shown by arrow C) from the injector 24. In the illustrated embodiment, another ignition zone 78 is provided in the injection plenum/nozzle 63 to selectively ignite the fuel and air from the injector 24, such as, for example, at start up.

Figure 3A:
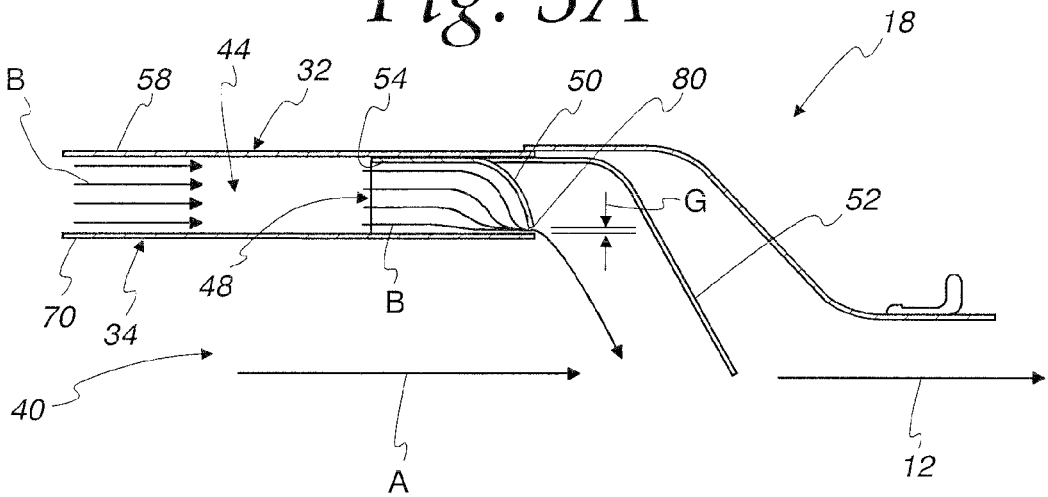
FIGS. 3A and 3B are enlarged views of the portion of the burner encircled by line 3-3 in FIG. 2.
Figure 6:
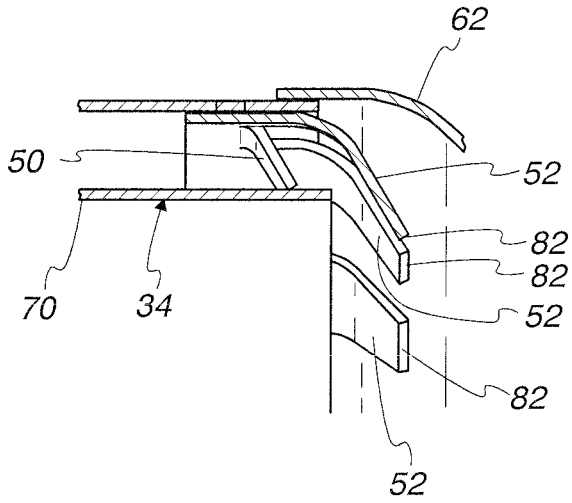
FIG. 6 is an enlarged, partial, transverse cross-sectional view showing an alternate embodiment of the burner of FIG. 1.

Each of the flow restrictor fingers 50 extends radially inwardly from the outer housing 10 to a terminal end 80 that is spaced a selected distance from the inner housing 34 to define a restricted flow gap G, as best seen in FIG. 3A, which determines the available flow area exiting the bypass flow path 44. Depending upon the particular operating conditions of the system 10 and the burner 18, the position of the flow restrictor fingers 50 relative to the inner housing 34 can be tuned or adjusted (such as by bending the fingers 50 or by increasing or decreasing the radius of curvature of the fingers 50) to optimize the gap G in order to achieve an optimum back pressure in the bypass flow path 44 that produces a desired ratio between the bypass flow and the combustion flow. This ratio can be important to achieving the desired combustion within the combustion flow path 40, maintaining a good flame 23 in the combustion flow path, and achieving the desired outlet temperature for the exhaust 12 exiting the burner 18. In this regard, the desired outlet temperature will be dependent upon both the combustion process within the combustion flow path 40 and the amount of the bypass flow through the bypass flow path 44 because the bypass flow will tend to cool the combustion flow exiting the combustion flow path 40 as it mixes with the combustion flow in the mixing zone 46. As best seen in the embodiment of FIG. 6, the finger 50 can be adjusted such that the gap G is completely closed, with the finger 50 touching the inner housing 34 and in some embodiments bonded to the inner housing 34 such as by welding or brazing.

Figure 3B:
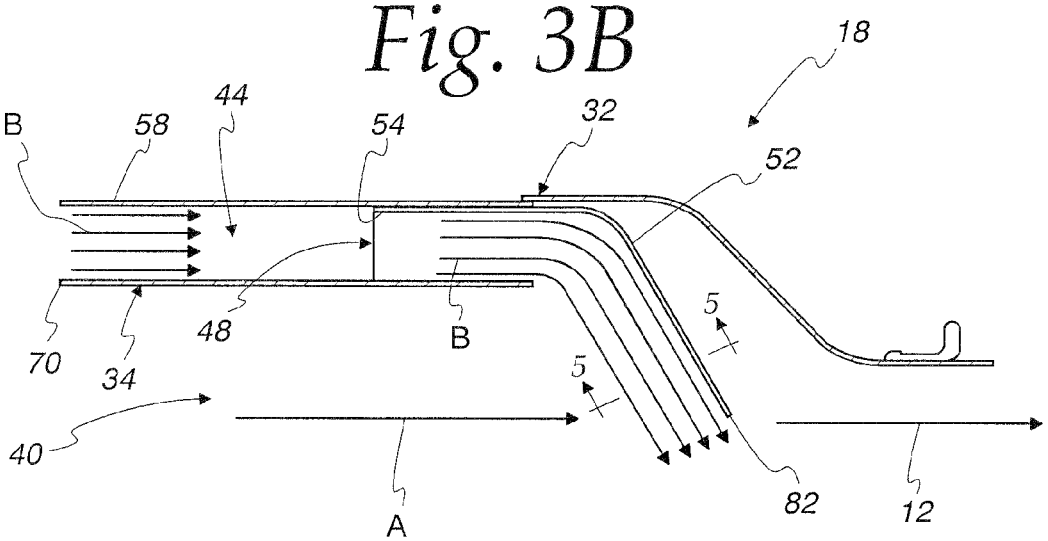

As best seen in FIG. 3B, each of the mixer fingers 52 extends along the outer housing 32 to a location downstream from the inner housing 34 and then extends inwardly from the location to a terminal end 82 within the mixing zone 46 so as to be impinged against by both the bypass flow and the combustion flow, while at the same time directing the bypass flow in a radially inward direction to the mixing zone 46 so as to improve the thermal mixing of bypass and combustion flows with each other to avoid hot zones within the exhaust 12 as it exits the burner 18. As seen in FIG. 3B, it is preferred that the fingers 52 initially extend axially from the flange 54 to provide a free flow area at each of the fingers 52 for the bypass flow exiting the bypass flow path 44.

Advantageously, because the relative position of the terminal end 80 of the flow restrictor fingers 50 can be custom tuned to achieve the particular requirements of a given application without requiring an entirely new burner design, the mixer 48 can allow for a single design of the burner 18 to be utilized for a number of different systems 10, each system 10 having different operating conditions. Thus, for example, two or more of the burners 18 can be made from components that are common to all of the burner units 18, particularly the outer and inner housings 32 and 34 and the mixer 48. The position of the flow restrictor fingers 50 relative to the inner housing 34 can then be adjusted/tuned to create the desired restricted flow area across the bypass flow path 44 to achieve the desired ratio of bypass flow to combustion flow for each of the different exhaust gas treatment systems 10.

It should also be appreciated that because the relative position between the inner housing and the flow restricting fingers 50 controls the back pressure in the bypass flow path 44, the burner 18 and mixer 48 can utilize a variety of different shapes for the outlet duct 62 with little or no impact to the back pressure in the bypass flow path.

Figure 5A:
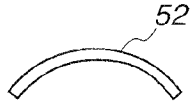
FIGS. 5A-5C are enlarged section views taken from line 5-5 in FIG. 3B, and showing alternate embodiments for a finger component of the burner.
Figure 5B:
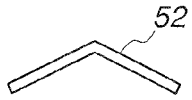
Figure 5C:
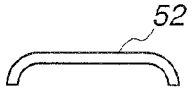

As best seen in FIGS. 5A-5C, each of the radially inwardly extending portions of the fingers 52 can have a scoop-shaped transverse cross section that will act to enhance the movement of the bypass flow into the mixing zone 46, with FIG. 5A showing a curved transverse cross section, FIG. 5B showing a V-shaped cross section, and FIG. 5C showing a U-shaped cross section wherein the longitudinal edges of the fingers 52 have been bent.

Figure 7:
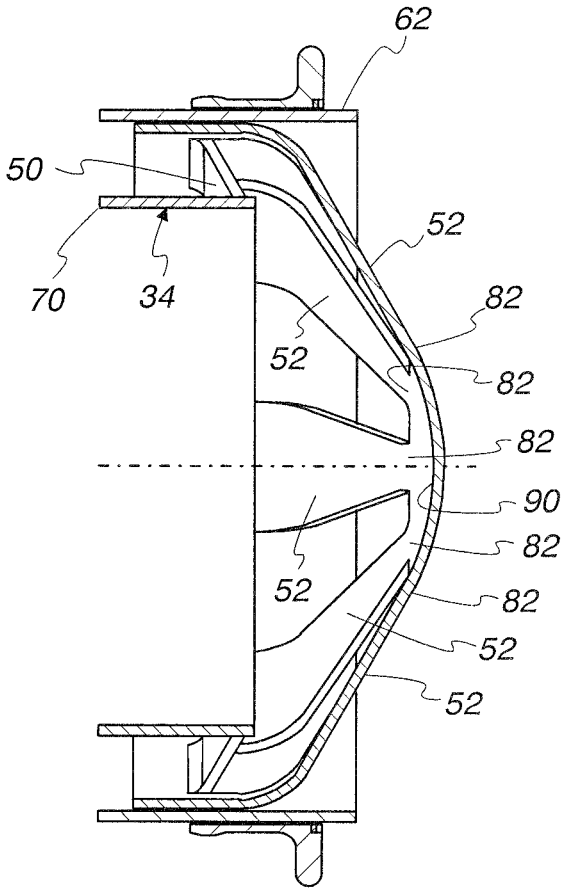
FIG. 7 is an enlarged transverse cross-sectional view showing yet another alternate embodiment of the burner of FIG. 1.

As yet another example, as shown in the embodiment of FIG. 7, the fingers 52 can be provided with a dome 90 at their ends 82, with the dome 100 being an integral part extending from the ends of the fingers 52. In this regard, it is believed that the dome 90 can provide advantageous mixing in a burner when the outlet duct 62 has a constant diameter so that it can be close-coupled with another device, such as a DPF, of the system 10. It is believed that the dome 90 helps to provide an appropriate temperature distribution across the face of the downstream device, such as a DPF, by capturing and/or dwelling some of the bypass flow directed to the dome 90 by the fingers 52 so that the relatively cooler bypass flow can better mix with the relatively hotter combustion flow.

It should be understood that while preferred embodiments of the burner 18 are shown in FIGS. 2, 3A, 3B, 4, 5A-5C, 6, and 7, a number of modifications are possible within the scope of the invention. For example, either or both of the inner and outer housings can be a single piece construction, rather than a multi-piece fabrication, or, on the other hand, can be fabricated from more pieces than illustrated. By way of further example, any or all of the fingers 50 and 52 can have a different width and/or shape than shown in FIGS. 2-4 depending upon the requirements of each particular application or applications such as, for example, each of the fingers 52 can have a wider transverse width at the end 82 than shown in FIGS. 2-4, or a narrower transverse width than shown in FIGS. 2-4. Similarly, where the fingers join the flange 54, each of the fingers 50 could be narrower in their transverse width and each of the fingers 52 could be wider in each of their transverse width or vice versa.

The invention claimed is:

1. A burner for use in a diesel exhaust gas treatment system to treat an exhaust flow from a diesel combustion process, the burner comprising:

an inner housing defining a combustion flow path to direct a first portion of the exhaust flow through an ignition zone wherein fuel is ignited;

an outer housing surrounding the inner housing to define a bypass flow path between the inner and outer housings to bypass a second portion of the exhaust flow around the ignition zone; and a mixing zone downstream of the combustion flow path and the bypass flow path to receive the first and second portions of the exhaust flow therefrom; and a mixer including a plurality of flow restrictor fingers that extend inwardly from the outer housing and across the bypass flow path to restrict an available flow area of the bypass flow path and a plurality of mixer fingers that extend inwardly from the outer housing into the mixing zone to be impinged against by both the first and second portions of the exhaust flow exiting the bypass flow path and the combustion flow path.

2. The burner of claim 1 wherein the inner housing and outer housing have cylindrical shapes and the bypass flow path has an annular cross-section defined between the inner and outer housings.

3. The burner of claim 2 wherein the mixer further comprises an annular flange mounted to an interior surface of the outer housing, with the flow restrictor fingers and the mixer fingers extending in a downstream direction from one side of the flange.

4. The burner of claim 1 wherein each of the flow restrictor fingers extends inward from the outer housing to a terminal end that is spaced a selected distance from the inner housing to define a restricted flow gap between the terminal end and the inner housing.

5. The burner of claim 1 wherein each of the mixer fingers extend along the outer housing to a location downstream from the inner housing and extend inwardly from the location to a location in the mixing zone.

6. The burner housing of claim 1 wherein the mixer is a made from a single, stamped piece of sheet metal.

7. The burner of claim 1 wherein the inner housing, outer housing, and mixer are fabricated components that are bonded together during assembly of the burner.

8. A burner for use in a diesel exhaust gas treatment system to treat an exhaust flow from a diesel combustion process, the burner comprising:

a cylindrical shaped inner housing defining a combustion flow path to direct a first portion of the exhaust flow through an ignition zone wherein fuel is ignited;

a cylindrical shaped outer housing surrounding the inner housing to define an annular bypass flow path between the inner and outer housings to bypass a second portion of the exhaust flow around the ignition zone; and a mixer including a flange fixed to an inner surface of the outer housing, the flange having a plurality of flow restrictor fingers that extend from the flange across the bypass flow path to restrict an available flow area of the bypass flow path and a plurality of mixer fingers having portions that extend inwardly from a location downstream from the inner housing.

9. The burner of claim 8 wherein:

each of the flow restrictor fingers extends inward from the flange to a terminal end that is spaced a selected distance from the inner housing to define a restricted flow gap between the terminal end and the inner housing; and each of the mixer fingers extend inwardly to a location that is radially inward of the inner housing.

10. A burner for use in a diesel exhaust gas treatment system to treat an exhaust flow from a diesel combustion process, the burner comprising:

a housing defining a combustion flow path to direct a first portion of the exhaust flow through an ignition zone wherein fuel is ignited, a bypass flow path to bypass a second portion of the exhaust flow around the ignition zone, a mixing zone downstream of the combustion flow path and the bypass flow path to receive the first and second portions of the exhaust flow therefrom; and a mixer located downstream of the ignition zone, the mixer including a plurality of flow restrictor fingers that extend across the bypass flow path to restrict an available flow area of the bypass flow path and a plurality of mixer fingers that extend into the mixing zone to be impinged against by both the first and second portions of the exhaust flow exiting the bypass flow path and the combustion flow path; and a flange having both the plurality of flow restrictor fingers and the plurality of mixer fingers extending therefrom.

11. The burner of claim 10 wherein the housing comprises an inner housing surrounded by an outer housing, with the combustion flow path defined within the inner housing and the bypass flow path defined between the inner housing and the outer housing.

12. The burner of claim 11 wherein the inner housing and outer housing have cylindrical shapes and the bypass flow path has an annular cross-section defined between the inner and outer housings.

13. The burner of claim 12 wherein the flange is mounted to an interior surface of the outer housing, with the flow restrictor fingers and the mixer fingers extending in a downstream direction from one side of the flange.

14. The burner of claim 11 wherein each of the mixer fingers extend along the outer housing to a location downstream from the inner housing and extend inwardly from the location to a location in the mixing zone.

15. The burner of claim 11 wherein the inner housing, outer housing, and mixer are fabricated components that are bonded together during assembly of the burner.

16. The burner of claim 10 wherein the mixer is a made from a single, stamped piece of sheet metal.

17. The burner of claim 10 wherein the flow restrictor fingers and the mixer fingers alternate along a length of the mixer.

18. The burner of claim 17 wherein the length of the mixer is a circumferential length that extends transverse to a flow direction defined by the bypass flow path.

19. A burner for use in a diesel exhaust gas treatment system to treat an exhaust flow from a diesel combustion r cess the burner comprising:

a housing defining a combustion flow path to direct a first portion of the exhaust flow through an ignition zone wherein fuel is ignited, a bypass flow path to bypass a second portion of the exhaust flow around the ignition zone, a mixing zone downstream of the combustion flow path and the bypass flow path to receive the first and second portions of the exhaust flow therefrom; and a mixer located downstream of the ignition zone, the mixer including a plurality of flow restrictor fingers that extend across the bypass flow path to restrict an available flow area of the bypass flow path, the flow restrictor fingers terminating within the bypass flow path, and a plurality of mixer fingers that extend downstream beyond the flow restrictor fingers into the mixing zone to be impinged against by both the first and second portions of the exhaust flow exiting the bypass flow path and the combustion flow path;

wherein the housing comprises an inner housing surrounded by an outer housing, with the combustion flow path defined within the inner housing and the bypass flow path defined between the inner housing and the outer housing, and wherein each of the flow restrictor fingers extends inward from the outer housing to a terminal end that is spaced a selected distance from the inner housing to define a restricted flow gap between the terminal end and the inner housing.

20. A method of providing burners for use in at least two diesel exhaust gas treatment systems having different operating conditions, each of the burners operating to ignite fuel for selectively raising the temperature of an exhaust flow from a diesel combustion process, the method comprising the steps of:

providing at least two burners, each of the burners being made from components that are common to all of the burners, the components comprising an inner housing to defining a combustion flow path, an outer housing surrounding the inner housing to define an bypass flow path, and a mixer having a plurality of flow restrictor fingers extending into the bypass flow path to overlay an outer surface of the inner housing;

adjusting a position of a plurality of the flow restrictor fingers relative to an inner housing in a first one of the burners to create a first desired restricted flow area across the bypass flow path to achieve a first desired ratio of bypass flow to combustion flow for one of the at least two diesel exhaust gas treatment systems having different operating conditions; and adjusting a position of a plurality of the flow restrictor fingers relative to an inner housing in a second one of the burners to create a second desired restricted flow area across the bypass flow path to achieve a second desired ratio of bypass flow to combustion flow for another of the at least two diesel exhaust gas treatment systems having different operating conditions.

* * * * *